US011015853B2

(12) United States Patent
Shao et al.

(10) Patent No.: US 11,015,853 B2
(45) Date of Patent: May 25, 2021

(54) ICE MAKER WITH THREE-BRANCH PIPE ASSEMBLY

(71) Applicants: HEFEI HUALING CO., LTD., Hefei (CN); HEFEI MIDEA REFRIGERATOR CO., LTD., Hefei (CN); MIDEA GROUP CO., LTD., Foshan (CN)

(72) Inventors: Yang Shao, Hefei (CN); Zhengguang Lv, Hefei (CN); Guangqing Yang, Hefei (CN); Zengqiang Si, Hefei (CN)

(73) Assignees: HEFEI HUALING CO., LTD., Hefei (CN); HEFEI MIDEA REFRIGERATOR CO., LTD., Hefei (CN); MIDEA GROUP CO., LTD., Foshan (CN)

( * ) Notice: Subject to any disclaimer, the term of this patent is extended or adjusted under 35 U.S.C. 154(b) by 158 days.

(21) Appl. No.: 16/357,087

(22) Filed: Mar. 18, 2019

(65) Prior Publication Data

US 2019/0212047 A1 Jul. 11, 2019

Related U.S. Application Data

(63) Continuation of application No. PCT/CN2016/100380, filed on Sep. 27, 2016.

(51) Int. Cl.
*F25C 1/18* (2006.01)
*F25C 1/25* (2018.01)
(Continued)

(52) U.S. Cl.
CPC ..... *F25C 1/18* (2013.01); *F25C 1/08* (2013.01); *F25C 1/20* (2013.01); *F25C 1/25* (2018.01); *F25C 2400/14* (2013.01)

(58) Field of Classification Search
CPC ..... F25C 1/18; F25C 1/20; F25C 1/25; F25C 1/08; F25C 2400/14
(Continued)

(56) References Cited

U.S. PATENT DOCUMENTS

2013/0133343 A1* 5/2013 Cur ..... F25D 11/025 62/66
2014/0165620 A1* 6/2014 Culley ..... F25C 1/18 62/71

FOREIGN PATENT DOCUMENTS

CN 201041443 Y 3/2008
CN 102331126 A 1/2012
(Continued)

OTHER PUBLICATIONS

Hefei Hualing Co., Ltd., First Office Action, CN201610856672.1, dated Nov. 10, 2017, 6 pgs.
(Continued)

*Primary Examiner* — Steve S Tanenbaum
(74) *Attorney, Agent, or Firm* — Morgan, Lewis & Bockius LLP

(57) ABSTRACT

An ice maker (100) includes an ice-making water tank (10), a water storage tank (20), a pipe assembly, a reversing member (40), and a driving member (50). The pipe assembly comprises a first branch pipe (310), a second branch pipe (320), and a third branch pipe (330). The first branch pipe (310) is connected to the water storage tank (20). The second branch pipe (320) and the third branch pipe (330) are separately connected to the ice-making water tank (10). The reversing member (40) is separately connected to the three branch pipes to control two of the branch pipes to be communicated and the rest one of the branch pipes to disconnected. The driving member (50) is connected to the third branch pipe in series. During ice making, the reversing member (40) controls the second branch pipe (320) and the
(Continued)

third branch pipe (330) to be communicated and controls the first branch pipe (310) to be disconnected. The driving member (50) operates to drive the water to circulate among the ice-making water tank (10), the second branch pipe (320) and the third branch pipe (330).

9 Claims, 3 Drawing Sheets

(51) Int. Cl.
*F25C 1/08* (2006.01)
*F25C 1/20* (2006.01)

(58) Field of Classification Search
USPC ..... 62/340
See application file for complete search history.

(56) References Cited

FOREIGN PATENT DOCUMENTS

| | | | |
|---|---|---|---|
| CN | 202119179 | U | 1/2012 |
| CN | 202371952 | U | 8/2012 |
| DE | 10336830 | A1 | 3/2005 |
| JP | 2007139398 | A | 6/2007 |
| JP | 4211025 | B2 | 1/2009 |

OTHER PUBLICATIONS

Hefei Hualing Co., Ltd., Second Office Action, CN201610856672.1, dated May 29, 2018, 4 pgs.
Hefei Hualing Co., Ltd., Third Office Action, CN201610856672.1, dated Nov. 23, 2018, 4 pgs.
Hefei Hualing Co. Ltd., International Search Report and Written Opinion, PCTCN2016100380, dated Jul. 6, 2017, 23 pgs.

* cited by examiner

ICE MAKER WITH THREE-BRANCH PIPE ASSEMBLY

CROSS REFERENCE TO RELATED APPLICATIONS

This application is a continuation of PCT/CN2016/100380, filed on Sep. 27, 2016, which is hereby incorporated by reference in its entirety.

FIELD

The present disclosure relates to a technical field of refrigeration equipment, and more particularly, to an ice maker.

BACKGROUND

In the related art, when an ice maker performs ice making, water is directly injected into a water box for ice making, and excess water overflows from an edge of the water box. In such a way, transparent ice cubes can be produced, but white bubbles may appear in the ice cubes due to an inconstant water flow direction, affecting the transparency, and the shape of the ice cubes may be irregular due to the inconstant water flow direction. Overall, the quality of the ice cubes produced by this technology is flawed.

SUMMARY

Embodiments of the present application aim to solve at least one of the technical problems existing in the related art. Accordingly, the present application is to propose an ice maker, such that ice cubes produced by the ice maker have an advantage of being transparent, flawless, regular and uniform.

The ice maker according to embodiments of the present application includes: an ice-making water tank, a water storage tank, a pipe assembly, a reversing member, and a driving member. The pipe assembly includes three branch pipes, a first branch pipe of the three branch pipes is connected with the water storage tank, and the second branch pipe and the third branch pipe of the three branch pipes are connected to the ice-making water tank separately. The reversing member is connected with each of the three branch pipes to control communication between two of the branch pipes and disconnection of the rest one of the branch pipes. The driving member is connected to the third branch pipe in series. When the ice maker produces ice, the reversing member controls the second branch pipe to be communicated with the third branch pipe and controls the first branch pipe to be disconnected, and the driving member operates to drive water to circulate among the ice-making water tank, the second branch pipe, and the third branch pipe.

For the ice maker according to embodiments of the present application, by providing the pipe assembly, in the ice making process of the ice maker, the reversing member controls the first branch pipe to be disconnected and controls the second branch pipe to be communicated with the third branch pipe, such that the water in the ice-making water tank realizes self-circulation flow of the ice making water in the ice-making water tank through the second branch pipe and the third branch pipe, and hence the ice making water flows evenly in a constant direction. Therefore, ice cubes produced by the ice maker have the advantage of being transparent, flawless, regular and uniform, the quality of ice making is improved, and the overall performance of the ice maker is upgraded.

According to an embodiment of the present application, after the ice maker finishes making ice, the reversing member controls the third branch pipe to be communicated with the first branch pipe and controls the second branch pipe to be disconnected, and the driving member stops operation to allow water in the ice-making water tank to flow towards the water storage tank through the third branch pipe and the first branch pipe.

According to an embodiment of the present application, the ice-making water tank is provided with a water input port, a water return port, and a drain port in a tank wall thereof, the second branch pipe being connected with the water return port, the third branch pipe being connected with the water input port, and at least one of the second branch pipe and the third branch pipe being connected with the drain port.

According to an embodiment of the present application, the water input port and the water return port are provided in opposite side walls of the ice-making water tank and at the same height.

According to an embodiment of the present application, the water input port and the water return port are arranged adjacent to an ice-making grid in the ice-making water tank.

According to an embodiment of the present application, the third branch pipe is connected with the drain port, and the drain port is arranged in a bottom wall of the ice-making water tank and/or a bottom of a side wall of the ice-making water tank.

According to an embodiment of the present application, the ice-making water tank is located above the water storage tank.

According to an embodiment of the present application, a water output pipe connected with the water storage tank, and a water output pump connected to the water output pipe in series.

According to an embodiment of the present application, the reversing member is configured as a three-way valve configured to control the third branch pipe to be communicated with the first branch pipe or the second branch pipe.

According to an embodiment of the present application, the driving member is configured as a water pump.

Additional aspects and advantages of embodiments of present disclosure will be given in part in the following descriptions, become apparent in part from the following descriptions, or be learned from the practice of the embodiments of the present application.

BRIEF DESCRIPTION OF THE DRAWINGS

These and/or other aspects and advantages of embodiments of the present application will become apparent and more readily appreciated from the following descriptions made with reference to the drawings, in which.

Figure 1:
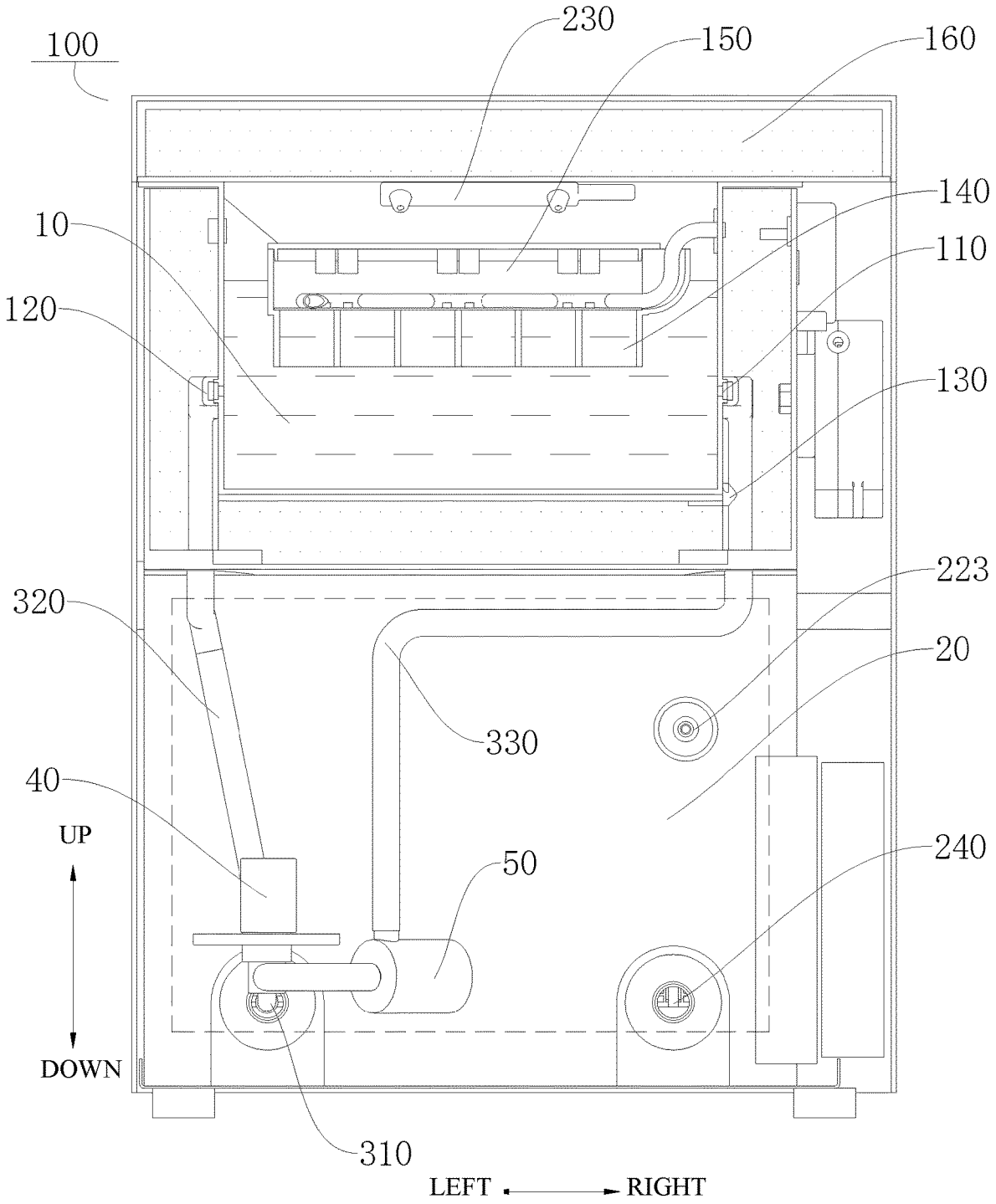
FIG. 1 illustrates a front view of an ice maker according to an embodiment of the present application.

REFERENCE NUMERALS ice maker 100, ice-making water tank 10, water input port 110, water return port 120, drain port 130, ice-making grid 140, ice-making evaporation assembly 150, thermal insulation layer 160, water storage tank 20, water output pipe 210, water output pump 2101, water input pipe 223, fourth branch pipe 224, fifth branch pipe front segment 2251, fifth branch pipe rear segment 2252, sixth branch pipe 226, water input pump 2261, water input control valve 227, flush pipe 230, drain pipe 240, drain pump 2401, first branch pipe 310, second branch pipe 320, third branch pipe 330, reversing member 40, driving member 50.

DETAILED DESCRIPTION

Embodiments of the present application will be described in detail, and examples of the embodiments will be illustrated in the drawings, in which the same or similar reference numerals indicate the same or similar elements or the elements having the same or similar functions. The embodiments described below with reference to drawings are illustrative, and used to generally understand the present application. The embodiments shall not be construed to limit the present application.

In the specification, it is to be understood that terms such as "upper," "lower," "front," "rear," "left," "right," "bottom," "inner," "outer," and the like should be construed to refer to the orientation or position relationship as shown in the drawings under discussion. These relative terms are only for convenience and simplicity of description, and do not indicate or imply that the referred device or element must have a particular orientation or be constructed or operated in a particular orientation. Thus, these terms shall not be construed to limit the present application.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present application, the term "a plurality of" means two or more than two, unless specified otherwise.

In the present application, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications or mutual interaction of two elements, which can be understood by those skilled in the art according to specific situations. An ice maker 100 according to embodiments of the present application will be described with reference to FIGS. 1-3.

Figure 2:
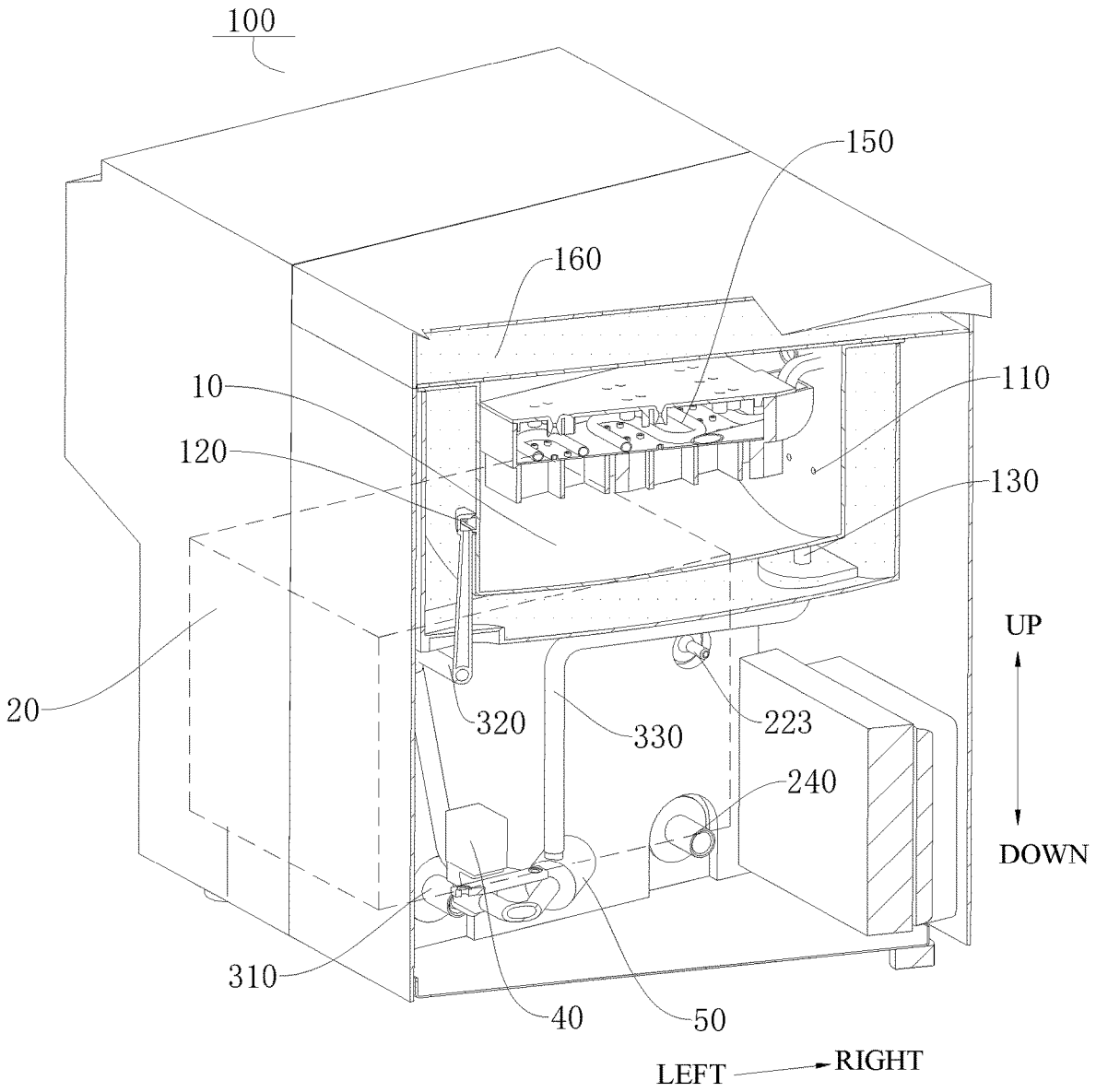
FIG. 2 illustrates a perspective view of an ice maker according to an embodiment of the present application.
Figure 3:
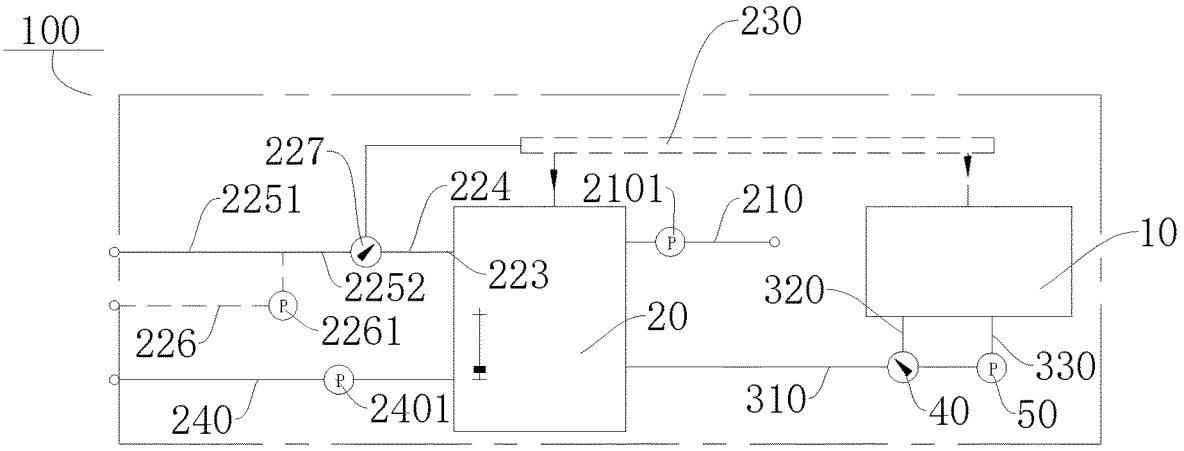
FIG. 3 illustrates a schematic view of an ice maker according to an embodiment of the present application.

As illustrated in FIGS. 1-3, the ice maker 100 according to embodiments of the present application includes an ice-making water tank 10, a water storage tank 20, a pipe assembly, a reversing member 40, and a driving member 50.

Specifically, as illustrated in FIG. 3, the pipe assembly includes three branch pipes, namely, a first branch pipe 310, a second branch pipe 320, and a third branch pipe 330. The first branch pipe 310 is connected with the water storage tank 20, and the second branch pipe 320 and the third branch pipe 330 are connected to the ice-making water tank 10 separately. The reversing member 40 is connected with each of the three branch pipes to control communication between two of the branch pipes and disconnection of the rest one of the branch pipes. The driving member 50 is connected to the third branch pipe 330 in series. When it is required to inject water into the ice-making water tank 10, the reversing member 40 breaks a water path between the first branch pipe 310 and the second branch pipe 320, and communicates a water path between the first branch pipe 310 and the third branch pipe 330, and the driving member 50 is activated, whereby the water in the water storage tank 20 can be injected into the ice-making water tank 10.

In an ice making process of the ice maker 100, the reversing member 40 controls the second branch pipe 320 to be communicated with the third branch pipe 330 and controls the first branch pipe 310 to be disconnected, and the driving member 50 operates to drive the water to circulate among the ice-making water tank 10, the second branch pipe 320, and the third branch pipe 330.

Thus, when the second branch pipe 320 acts as a water return pipe, the third branch pipe 330 for water inflow can cooperate with the second branch pipe 320 and the water tank 10 to form a self-circulation path, and the circulating return water does not need to flow through the water storage tank 20. The driving member 50 configured to provide a driving force for water inflow can also provide self-circulation power, such that each of the third branch pipe 330 and the driving member 50 can be used for more than one purpose, which makes the internal structure of the ice maker 100 more compact.

For the ice maker 100 according to embodiments of the present application, by providing the pipe assembly, in the ice making process of the ice maker 100, the reversing member 40 controls the first branch pipe 310 to be disconnected and controls the second branch pipe 320 to be communicated with the third branch pipe 330, such that the water in the ice-making water tank 10 realizes self-circulation flow of the ice making water in the ice-making water tank 10 through the second branch pipe 320 and the third branch pipe 330, and hence the ice making water flows evenly in a constant direction. Therefore, ice cubes produced by the ice maker 100 have an advantage of being transparent, flawless, regular and uniform, the quality of ice making is improved, and the overall performance of the ice maker 100 is upgraded. Additionally, since the third branch pipe 330 for water inflow and the driving member 50 accomplish the return water circulation, internal components of the ice maker 100 become more compact, resulting in a simple structure, simple water paths, and fewer components.

According to an embodiment of the present application, as illustrated in FIGS. 1-3, after the ice maker 100 finishes making ice, the reversing member 40 controls the third branch pipe 330 to be communicated with the first branch pipe 310 and controls the second branch pipe 320 to be disconnected, and the driving member 50 stops operation to allow the water in the ice-making water tank 10 to flow towards the water storage tank 20 through the third branch pipe 330 and the first branch pipe 310. Thus, the water in the ice-making water tank 10 can be discharged when the ice making is completed. As illustrated in FIGS. 1-3, when the ice making is completed, by breaking the water path between the first branch pipe 310 and the second branch pipe 320 and communicating the water path between the third branch pipe 330 and the first branch pipe 310, and by bringing the driving member 50 into a state of being stopped, the water in the ice-making water tank 10 can flow into the water storage tank 20 through the third branch pipe 330 and the first branch pipe 310 sequentially because the ice-making water tank 10 is arranged above the water storage tank 20.

Further, as illustrated in FIGS. 1 and 2, the ice-making water tank 10 is provided with a water input port 110, a water return port 120, and a drain port 130 in a tank wall thereof. The second branch pipe 320 is connected with the water return port 120, the third branch pipe 330 is connected with the water input port 110, and at least one of the second branch pipe 320 and the third branch pipe 330 is connected with the drain port 130. That is, the drain port 130 can be configured to be connected with the second branch pipe 320 or can be configured to be connected with the third branch pipe 330. A plurality of drain ports 130 can be provided, a part of the drain ports 130 being connected with the second branch pipe 320 while another part of the drain ports 130 being connected with the third branch pipe 330, which will not be specifically defined herein. Hence, different pipe assemblies can be communicated or disconnected under different working conditions of the ice maker 100 to achieve different water flow states.

Preferably, as illustrated in FIGS. 1-2, the water input port 110 and the water return port 120 are provided in opposite side walls of the ice-making water tank 10 and at the same height. Thus, the water in the ice-making water tank 10 can be allowed to flow evenly in the constant direction, so that the resulting ice cubes are transparent, flawless, regular and uniform.

Further, the water input port 110 and the water return port 120 are arranged adjacent to an ice-making grid 140 in the ice-making water tank 10. It needs to be noted that since the ice maker requires water in the ice making process, an ice-making evaporation assembly 150 is immersed in the water in the ice-making water tank 10, especially the ice-making grid 140 has to be immersed in the water. Thus, the water input port 110 and the water return port 120 are arranged as close as possible to the ice-making grid 140, so that the water can flow evenly through the ice cubes, and the water flow rate around the ice cubes can be increased, thereby further ensuring the transparency, uniformity and quality of the obtained ice cubes. It should be noted that, in order to prepare uniform and transparent ice cubes, in the ice making process, the water flow direction in the ice-making water tank 10 needs to keep constant, the water flow rate needs to be even, the water input port 110 and the water return port 120 are arranged at the height of the ice-making water tank 10, and the water input port 110 and the water return port 120 are arranged adjacent to the ice-making grid 140, whereby the transparency and uniformity of the obtained ice cubes can be guaranteed, and the quality of the ice cubes can be improved.

According to an embodiment of the present application, as illustrated in FIGS. 1 and 2, the third branch pipe 330 is connected with the drain port 130, and the drain port 130 is arranged in a bottom wall of the ice-making water tank 10 or in a bottom of a side wall of the ice-making water tank 10. That is, the drain port 130 may be arranged in the bottom wall of the ice-making water tank 10, or may be arranged in the bottom of the side wall of the ice-making water tank 10. Certainly, a plurality of drain ports 130 can be provided, a part of the drain ports 130 being provided in the bottom wall of the ice-making water tank 10 while another part of the drain ports 130 being provided in the bottom of the side wall of the ice-making water tank 10, which will not be specifically defined herein. For instance, as illustrated in FIG. 1, the drain port 130 is connected with the third branch pipe 330, and the drain port 130 is arranged in a position of a right bottom wall of the ice-making water tank 10 (referring to an up-and-down direction and a left-and-right direction as illustrated in FIG. 1). Therefore, when the ice making is completed, the third branch pipe 330 can be communicated with the first branch pipe 310 to realize the drainage of the ice-making water tank 10.

Preferably, as illustrated in FIGS. 1 and 2, the ice-making water tank 10 is located above the water storage tank 20. Hence, when the ice making is completed, the water in the ice-making water tank 10 can automatically flow into the water storage tank 20 by gravity because the ice-making water tank 10 is located above the water storage tank 20.

Further, as illustrated in FIG. 3, the ice maker 100 further includes a water output pipe 210 and a water output pump 2101. The water output pipe 210 is connected with the water storage tank 20, and the water output pump 2101 is connected to the water output pipe 210 in series. Thus, when a user needs to use the water in the water storage tank 20, the water output pump 2101 can be activated to pump out the water in the water storage tank 20 along the water output pipe 210. It should be understood that, when the ice making is completed, the water in the ice-making water tank 10 is discharged into the water storage tank 20. The water in the water storage tank 20 has a relatively low temperature, so when the user needs to use the water of relatively low temperature, the water in the water storage tank 20 can be pumped out for use directly by the water output pump 2101.

According to some embodiments of the present application, the reversing member 40 is configured as a three-way valve configured to control the third branch pipe 330 to be communicated with the first branch pipe 310 or the second branch pipe 320. By selecting the three-way valve as the reversing member 40, the reversing member 40 is convenient to install and is simple to operate, and the production cost of the reversing member 40 can be reduced.

In some embodiments of the present application, the driving member 50 may be a water pump. Thus, during water injection into the ice-making water tank 10, the water in the water storage tank 20 can be pumped into the ice-making water tank 10 through the water pump, and under the drive of the water pump, the water in the ice-making water tank 10 can be self-circulated among the ice-making water tank 10, the second branch pipe 320 and the third branch pipe 330 in the ice making process, so that the ice making water flows evenly in the constant direction, and the ice cubes produced are transparent and uniform.

The ice maker 100 according to the present application will be described in detail by way of a specific embodiment with reference to FIGS. 1-3.

As illustrated in FIGS. 1-3, the ice maker 100 according to the embodiment of the present application includes an ice-making water tank 10, a water storage tank 20, a pipe assembly, a reversing member 40, and a driving member 50.

Specifically, as illustrated in FIG. 1, the pipe assembly includes three branch pipes, namely, a first branch pipe 310, a second branch pipe 320, and a third branch pipe 330. The first branch pipe 310 is connected with the water storage tank 20. A first end of the second branch pipe 320 and a first end of the third branch pipe 330 are both connected with the ice-making water tank 10, while a second end of the second branch pipe 320 and a second end of the third branch pipe 330 are both connected with the first branch pipe 310. The reversing member 40 is provided in a position where the first branch pipe 310, the second branch pipe 320 and the third branch pipe 330 are communicated, and the reversing member 40 is configured to control communication between two of the branch pipes and disconnection of the rest one of the branch pipes. The driving member 50 is connected to the third branch pipe 330 in series.

As illustrated in FIGS. 1 and 2, the ice-making water tank 10 is provided with a water input port 110, a water return port 120, and a drain port 130 in a tank wall thereof. The water return port 120 is arranged in a left wall of the ice-making water tank 10 and at a position close to the ice-making grid 140, and is connected with the second branch pipe 320. The water input port 110 is arranged in a right wall of the ice-making water tank 10 and at a position close to the ice-making grid 140. The height of the water input port 110 is flush with the height of the water return port 120. The water input port 110 is connected with the third branch pipe 330. The drain port 130 is arranged at a lower right position of the ice-making water tank 10 and is connected with the third branch pipe 330.

When it is required to inject water into the ice-making water tank 10, the reversing member 40 breaks a water path between the first branch pipe 310 and the second branch pipe 320, and communicates a water path between the first branch pipe 310 and the third branch pipe 330, and the driving member 50 is activated, whereby the water in the water storage tank 20 can be injected into the ice-making water tank 10.

In an ice making process of the ice maker 100, the reversing member 40 controls the second branch pipe 320 to be communicated with the third branch pipe 330 and controls the first branch pipe 310 to be disconnected, and the driving member 50 operates to drive the water to circulate among the ice-making water tank 10, the second branch pipe 320, and the third branch pipe 330.

When the ice making is completed, the reversing member 40 breaks the water path between the first branch pipe 310 and the second branch pipe 320 and communicates the water path between the first branch pipe 310 and the third branch pipe 330, and the driving member 50 is brought into a state of being stopped, such that the water in the ice-making water tank 10 can automatically flow into the water storage tank 20 because the ice-making water tank 10 is located above the water storage tank 20, thereby realizing the drainage of the ice-making water tank 10.

Additionally, as illustrated in FIGS. 1 and 2, the ice maker 100 is further provided with a thermal insulation layer 160. The thermal insulation layer 160 is configured to weaken heat exchange between the inside of the ice maker 100 and the outside, thereby effectively maintaining the temperature in the ice-making water tank 10 and saving energy.

An ice-making evaporation assembly 150 is further provided above an ice-making grid 140. When the ice making is completed, the water in the ice-making water tank 10 is first drained through the drain port 130, and the ice-making evaporation assembly 150 heats the ice-making grid 140, such that a wall surface of the ice-making grid 140 in contact with the ice cubes is heated. Since the ice-making grid 140 is opened downwards, the obtained ice cubes can separate from the ice-making grid 140 by gravity after being heated. The ice maker 100 is internally provided with an ice pushing device and an ice storing device (not illustrated), such that the ice pushing device can push the ice cubes into the ice storing device for storage after the ice cubes falling off the ice-making grid 140.

As illustrated in FIG. 3, the water storage tank 20 is provided with a water input pipe 223 and a flush pipe 230. The water input pipe 223 is configured to control water inflow of the water storage tank 20, and the flush pipe 230 is configured to flush and clean the ice-making water tank 10 and the water storage tank 20. The water input pipe includes a fourth branch pipe 224, a fifth branch pipe, and a sixth branch pipe 226. The fifth branch pipe includes a fifth branch pipe front segment 2251 and a fifth branch pipe rear segment 2252. A water input control valve 227 is provided in a position where the fourth branch pipe 224 is communicated with the fifth branch pipe rear segment 2252 and the flush pipe 230. The sixth pipe is provided with a water input pump 2261. The water input pipe 223 is provided with a water source pressure detection module (not illustrated). When it is required to inject water into the water storage tank 20, the water input control valve 227 disconnects the flush pipe 230 and communicates the fifth branch pipe with the fourth branch pipe 224. When the detection module detects that the water pressure at the water source is high, a water path between the fifth branch pipe and the fourth branch pipe 224 is communicated, and the water input from the water source realizes the water injection into the water storage tank 20 through the fifth branch pipe and the fourth branch pipe 224 sequentially. When the detection module detects that the water pressure at the water source is low, a water path among the sixth branch pipe 226, the fifth branch pipe rear segment 2252 and the fourth branch pipe 224 is communicated, and the water input pump 2261 is activated, such that the water from the water source is driven to pass through the sixth branch pipe 226, the fifth branch pipe rear segment 2252 and the fourth branch pipe 224 sequentially to realize the water injection into the water tank.

The water storage tank 20 is further provided with a water output pipe 210 and a water output pump 2101. When the user needs to use the water from the water storage tank 20, the water in the water storage tank 20 can be pumped out for use by means of the water output pump 2101. The bottom of the water storage tank 20 is provided with a drain pipe 240 and a drain pump 2401. The water in the water storage tank 20 can be pumped and drained out if the ice maker 100 is not used for a long time.

Therefore, by providing the pipe assembly, in the ice making process of the ice maker 100, the reversing member 40 controls the first branch pipe 310 to be disconnected and controls the second branch pipe 320 to be communicated with the third branch pipe 330, such that the water in the ice-making water tank 10 realizes self-circulation flow of the ice making water in the ice-making water tank 10 through the second branch pipe 320 and the third branch pipe 330, and hence the ice making water can flow evenly in a constant direction. Hence, the ice cubes produced by the ice maker 100 have an advantage of being transparent, flawless, regular and uniform, the quality of ice making is improved, and the overall performance of the ice maker 100 is upgraded.

Reference throughout this specification to "an embodiment," "an example," or the like means that a particular feature, structure, material, or characteristic described in connection with the embodiment or example is included in at least one embodiment or example of the present application. Thus, the appearances of the phrases throughout this specification are not necessarily referring to the same embodiment or example. Furthermore, the particular features, structures, materials, or characteristics may be combined in any suitable manner in one or more embodiments or examples.

Although embodiments of the present application have been shown and described, it would be appreciated by those skilled in the art that various changes, modifications, alternatives and variations can be made to the above embodiments of the present application without departing from the principle of the present application. The scope of the present application is defined by the claims and the like.

What is claimed is:

1. An ice maker, comprising:

an ice-making water tank, a water storage tank, a pipe assembly, a valve, and a pump, wherein the pipe assembly further comprises three branch pipes, a first branch pipe of the three branch pipes is connected to the water storage tank, and a second branch pipe and a third branch pipe of the three branch pipes are connected to the ice-making water tank separately; the valve is connected to each of the three branch pipes to control communication between two of the branch pipes and disconnection of the rest one of the branch pipes; the pump is connected to the third branch pipe in series;

wherein when the ice maker makes ice, the valve controls the second branch pipe to be communicated with the third branch pipe and controls the first branch pipe to be disconnected, and the pump operates to drive water to circulate among the ice-making water tank, the second branch pipe, and the third branch pipe; and wherein the ice-making water tank is provided with a water input port, a water return port, and a drain port in a tank wall of the ice-making water tank, the second branch pipe is connected to the water return port, the third branch pipe is connected to the water input port, and at least one of the second branch pipe and the third branch pipe is connected to the drain port.

2. The ice maker according to claim 1, wherein, after the ice maker finishes making ice, the valve controls the third branch pipe to be communicated with the first branch pipe and controls the second branch pipe to be disconnected, and the pump stops operation to allow water in the ice-making water tank to flow towards the water storage tank through the third branch pipe and the first branch pipe.

3. The ice maker according to claim 1, wherein the water input port and the water return port are provided in opposite side walls of the ice-making water tank and at the same height.

4. The ice maker according to claim 1, wherein the water input port and the water return port are arranged adjacent to an ice-making grid in the ice-making water tank.

5. The ice maker according to claim 1, wherein the third branch pipe is connected to the drain port, and the drain port is arranged in a bottom wall of the ice-making water tank and/or a bottom of a side wall of the ice-making water tank.

6. The ice maker according to claim 1, wherein the ice-making water tank is located above the water storage tank.

7. The ice maker according to claim 1, further comprising:

a water output pipe connected to the water storage tank, and a water output pump connected to the water output pipe in series.

8. The ice maker according to claim 1, wherein the valve is a three-way valve configured to control the third branch pipe to be communicated with the first branch pipe or the second branch pipe.

9. The ice maker according to claim 1, wherein the pump is configured as a water pump.

* * * * *